United States Patent [19]

Imasu

[11] 4,140,439

[45] Feb. 20, 1979

[54] RECIPROCATING COMPRESSOR HAVING A CUT-OFF DEVICE OPERABLE WITHIN PREDETERMINED ANGULAR RANGE

[75] Inventor: Kenichiro Imasu, Shiga, Japan

[73] Assignee: Matsushita Electric Industrial Co., Ltd., Osaka, Japan

[21] Appl. No.: 787,459

[22] Filed: Apr. 14, 1977

[30] Foreign Application Priority Data

Apr. 20, 1976 [JP] Japan ..... 51-45066

[51] Int. Cl.[2] ..... F04B 17/00

[52] U.S. Cl. ..... 417/313; 417/410; 417/902

[58] Field of Search ..... 417/313, 1, 299, 360, 417/410, 902

[56] References Cited

U.S. PATENT DOCUMENTS 2,072,307 3/1937 Kenney ..... 417/360 X
2,985,010 5/1961 Piltz ..... 417/1 UX
3,075,466 1/1963 Agnew et al. ..... 417/415

FOREIGN PATENT DOCUMENTS 871172 6/1961 United Kingdom ..... 417/410

*Primary Examiner*—Carlton R. Croyle
*Assistant Examiner*—Richard E. Gluck
*Attorney, Agent, or Firm*—Wenderoth, Lind & Ponack

[57] ABSTRACT

A motor compressor has a compression mechanism including compressor components such as a cylinder and a piston and a driving motor coupled to a power source for driving the compressor components through a crank mechanism, and a cut-off device for cutting off the driving motor from the power source. The cut-off device is adapted to cut off the driving motor from the power source when the rotational angle of a crank shaft of the crank mechanism is within a predetermined range at the time of shutting down of operation of the driving motor for minimizing the vibration of the motor compressor.

9 Claims, 6 Drawing Figures

RECIPROCATING COMPRESSOR HAVING A CUT-OFF DEVICE OPERABLE WITHIN PREDETERMINED ANGULAR RANGE

BACKGROUND OF THE INVENTION

The present invention relates to a compressor and more particularly, to the shut-down control of an electrically driven motor compressor in which vibration of the compressor components and motor due to inertia force during operation is reduced at the time of stopping thereby decreasing vibrations and noise of the compressor.

Commonly, a motor compressor, for example, a hermetically sealed motor compressor which includes a motor-compressor unit spring-suspended within a housing is widely employed as a cooling medium compressor or air compressor for the refrigeration circuit in refrigerators, air-conditioners and the like, and also as a reciprocating type compressor for similar purposes.

For the operation of shutting down a motor compressor of the above described type, it has been a general practice to cut off the power supply depending on the necessity. In such shut-down, however, it is known that extremely large vibrations tend to take place, frequently giving rise to abnormal noises, mainly due to compressor components which are supported by spring means striking against surrounding structures in the housing.

Accordingly, the designing a vibration-absorbing spring system for such conventional compressors, the vibration attenuating effect thereof during steady operation of the compressor is sacrificed to a certain extent, with various countermeasures being taken into account, such as an increase of the spring constant for preventing large vibrations at the time of shut-down or providing sufficient space to prevent the compressor components from striking against the surrounding structures, thus resulting in a higher cost and larger size of the motor compressor would otherwise be than necessary.

SUMMARY OF THE INVENTION

Accordingly, an essential object of the present invention is to provide a motor compressor in which vibrations of the compressor components and electric motor at the time of shut-down are reduced, to thereby enable a decrease in the spring constant for the vibration absorbing spring, with a consequent reduction in the cost and size of the motor compressor.

Another important object of the present invention is to provide a motor compressor of the above described type in which the vibrations of the compressor components and electric motor are kept to at a minimum, to thereby obtain a stable shutting down condition whenever the motor compressor is stopped.

A further object of the present inventon is to provide a motor compressor of the above described type in which construction of a control circuit for shutting down the electric motor is simplified so as to be readily put into actual use.

In accomplishing these objects, according to one preferred embodiment of the present invention, the hermetically sealed motor a compressor comprises compression mechanism including compressor components having a cylinder and a piston and a driving motor coupled to a power source for driving the compressor components through crank mechanism, and cut-off means for cutting off the driving motor from the power source. The cut-off means is adapted to cut off the driving motor from the power source when the rotational angle of a crank shaft of the crank mechanism at the time of shutting down of operation of the driving motor is within a predetermined range, for example, between 120° and 260°. By the arrangement as described above, the undesirable vibration at the time of shutting down of the motor compressor is reduced to an extremely low level, with substantial elimination of the disadvantages inherent in the conventional compressors.

BRIEF DESCRIPTION OF THE DRAWINGS

These and other objects and features of the present invention will become apparent from the following description taken in conjunction with the preferred embodiment thereof with reference to the attached drawings in which.

DETAILED DESCRIPTION OF THE INVENTION

Figure 1:
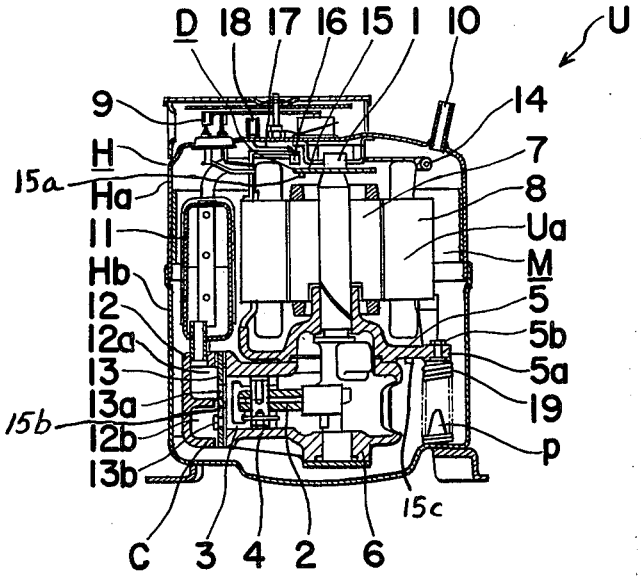
FIG. 1 is a schematic side sectional view of a motor compressor according to one preferred embodiment of the present invention.

Before the description of the present invention proceeds, it is to be noted that like parts are designated by like reference numerals throughout the several views of the accompanying drawings.

Referring now to the drawings, there is shown in FIG. 1 a motor compressor U according to one preferred embodiment of the present invention which includes a compressor section or compressor components C integrally formed with a driving motor M to form a motor compressor unit Ua and supported within a hermetically sealed housing H through spring means 19 in a manner described hereinbelow.

The compressor section C further includes a crank shaft 1 rotatably supported by an upper bearing member 5 and lower bearing member 6, and a piston 3 reciprocatingly accommodated in a cylinder 4 and connected by a connecting rod 2 to a lower part of the crank shaft 1 for compressing, for example, cooling medium or cooling gas (not shown) within the cylinder 4. The crank shaft 1 is secured at its upper portion to a rotor 7 which is surrounded by a stator 8 of the driving motor M so as to be rotated by energization of the motor M by electric current furnished through power supply terminals 9. The housing H, including an upper portion Ha and lower portion Hb which are rigidly connected to each other, has an inlet fitting or suction pipe 10 extending upwardly from the top wall of the upper portion Ha for admitting the cooling gas into the housing H therethrough. The cooling gas sucked in through the suction pipe 10 is drawn into the cylinder 4 via a suction opening 13*a* formed in a valve plate 13 through a suction muffer 11 and a suction chamber 12*a* in a cylinder head 12. The cooling gas of low pressure thus introduced into the cylinder 4 is compressed through reciprocation of the piston 3 so as to be imparted with high pressure and is discharged outside through a discharge conduit 14 connected to an outlet fitting or discharge pipe (not shown) via a discharge opening 13b formed in the valve plate 13, a discharge chamber 12b in the cylinder head 12 and a discharge muffer (not shown). The valve plate 13 is provided, at its suction and discharge openings 13a and 13b, with automatic suction and discharge valves (not shown), respectively, which open and close in response to the pressure of the cooling medium.

The motor compressor U further includes a crank angle detection section D associated with the rotation of the crank shaft 1 and mainly comprising a magnet member 15a buried in a disk 15 which is secured close to the upper end of the crank shaft 1 and a magnetic detection element 16 disposed adjacent to the disk 15 for detecting magnetism of the magnet member and for supplying through a lead wire 17, signals of pulse waveform to a terminal 18 for external connection. The compressor section C integrally formed with the driving motor M in the above described manner is suspended within the housing H through the spring means, for example, by three spring members 19 each disposed between a screw 5b threaded into an opening in a flange portion 5a of the upper bearing 5 and a corresponding projection p extending upwardly from the bottom wall of the lower housing Hb for vibration absorption.

By the above arrangement, when the power supply is cut off during continuous operation of the motor compressor U under a predetermined condition for a refrigeration circuit including a heat exchanger and decompressor device (not shown), the motor compressor unit Ua supported by the spring members 19 as described above stops operation with a large vibration. Results of measurements taken at this time for examining the relation between the maximum value of vibration amplitude on the stator 8 of the driving motor M and the crank angle of the crank shaft 1 are shown in FIG. 2 in graphical form.

Figure 2:
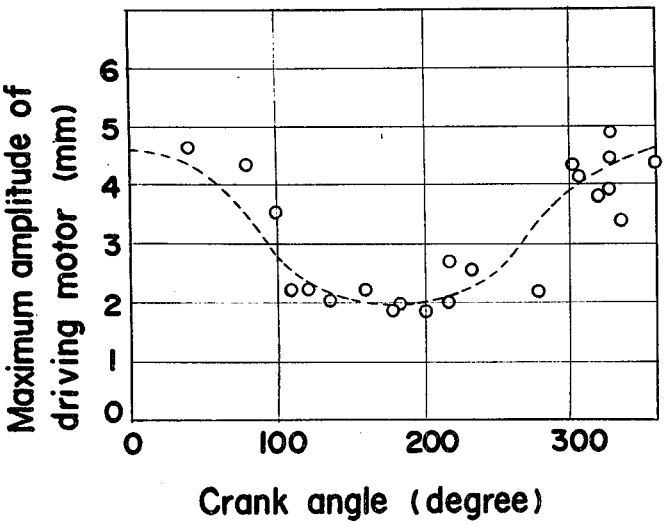
FIG. 2 is a graph showing the relation between crank angle and vibration amplitude of a driving motor employed in the motor compressor of FIG. 1, FIGS. 3 and 4 are block diagrams explanatory of the functioning of a control circuit employed in the motor compressor of FIG. 1.

In the graph of FIG. 2 in which the crank angle is taken as the abscissa and the vibration amplitude of the driving motor M as the ordinate, the piston 3 is at the top dead center at the crank angle of 0° and 360° respectively, and at the bottom dead center at the crank angle of 180° under the testing conditions for the motor compressor U at low pressure 4.8 kg/cm$^2$g, high pressure 20.0 to 23.0 kg/cm$^2$g, under subcool degree 5 to 8° C., and superheat degree 5 to 10° C. In FIG. 2, if the power supply is cut off within the crank angle range of 120° to 260°, it has been found that the vibration amplitude is extremely small as compared with that at other crank angles. Accordingly, the vibrations of the motor compressor at the time of shutting down can be suppressed to a very small level by cutting off the power supply for the motor compressor U in the range as described above. It has also been found in similar tests that if the testing conditions described above are altered, the crank angle at a position of the smallest vibration amplitude is shifted either rightward or leftward with respect to a central point of approximately 180° in the range from 120° to 260° of the test results in FIG. 2. Accordingly, even when load conditions for a given motor compressor are altered, the vibration of the motor compressor at the time of the shut-down is very small, if the operation of the motor compressor is stopped approximately in the range of the crank angle of from 120° to 260°.

Figure 3:
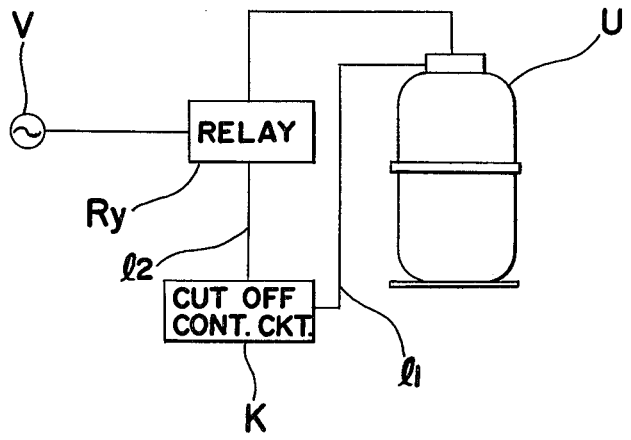

Referring also to FIG. 3, the shut-down control arrangement for the driving motor M will be described hereinbelow.

In FIG. 3, the hermetically sealed type motor compressor U is connected through a relay Ry and a power supply cut off control circuit K to the driving power source V, with the control circuit K causing the power source V to be turned on or off through the relay Ry, in which arrangement, the pulse waveform signals obtained by the positional detection at the crank angle detection section D (FIG. 1) of the motor compressor U are fed through a lead wire $l_1$ to the power supply cut off control circuit K which normally turns off the relay Ry through a lead wire $l_2$ to stop the driving motor M (FIG. 1) only when the crank angles are within the range of from 120° to 260°.

Figure 4:
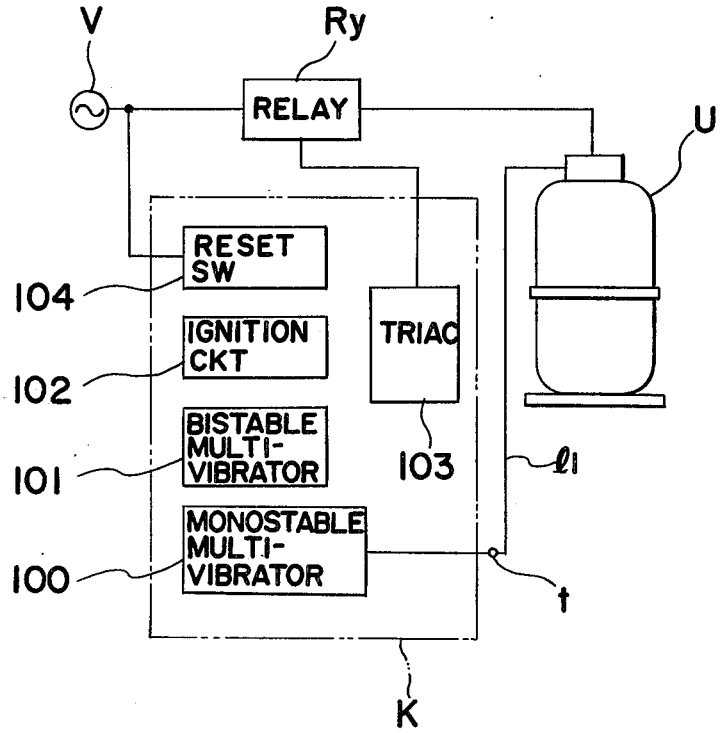
Figure 5:
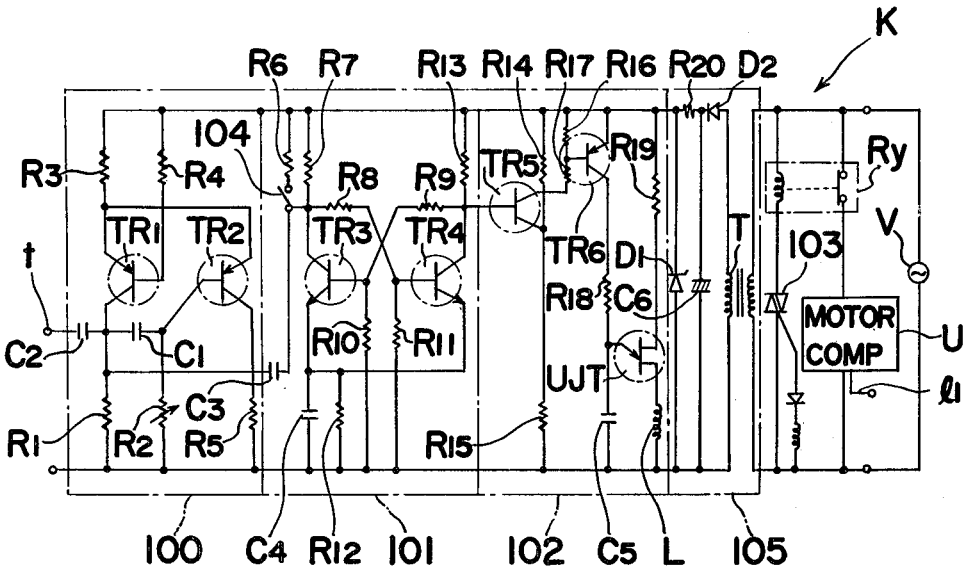
FIG. 5 is an electrical circuit diagram showing the construction of the control circuit of FIGS. 3 and 4.

Referring also to FIGS. 4 and 5, more specifically, the pulse waveform signals detected by the crank angle detection section D as described above are fed through the lead wire $l_1$ into an input terminal t of the power supply cut off control circuit K which further includes a monostable multi-vibrator circuit 100 formed by transistors TR1 and TR2, resistors R1 and R5 and capacitors C1 and C2, a bistable multi-vibrator circuit 101 constituted by transistors TR3 and TR4, resistors R6 to R13 and capacitors C3 and C4 and associated with a reset switch 104, a triac ignition circuit 102 having transistors TR5 and TR6, a uni-junction transistor UJT, resistors R14 to R19, a capacitor C5 and a coil L, a power source circuit 105 having diodes D1 and D2, a resistor R20, a capacitor C6 and a transformer T, and a triac 103, and are converted at the monostable multi-vibrator circuit 100 into rectangular waves having a desired time lag. The rectangular waves are subsequently fed into the bistable multi-vibrator circuit 101 and develop output from the moment of falling of the rectangular waves for actuating the triac ignition circuit 102 at the subsequent stage. The ignition circuit 102 should be so arranged as to ignite the triac 103 within a very short period of time after development of the output from the bistable multi-vibrator circuit 101 at the previous stage. When the triac 103 is energized through the ignition circuit 102, the relay Ry is actuated to suspend electric current to the motor compressor U. Resetting of the ignition circuit 102 is effected by closing the reset switch 104 to supply a reset trigger signal to the bistable multi-vibrator circuit 101, while the power supply cut off control circuit K has its power supplied from the power source circuit 105.

Figure 6:
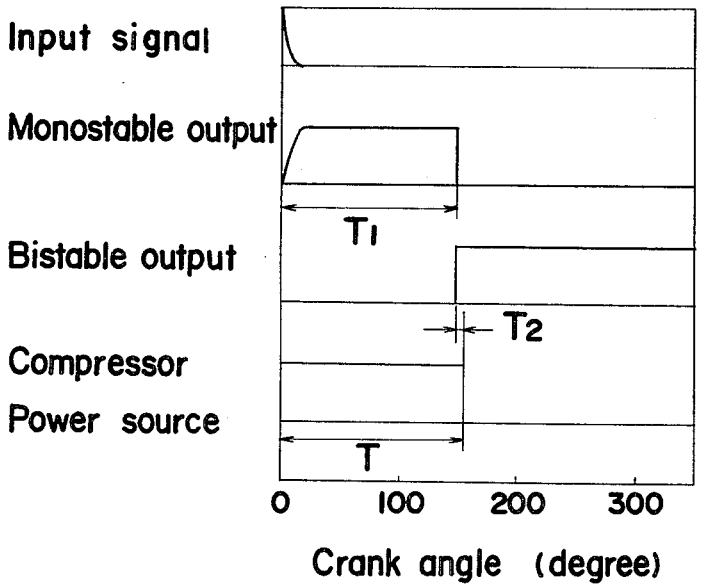
FIG. 6 is a chart explanatory of setting shutdown time for the motor compressor of FIG. 1.

Referring to FIG. 6, cutting off the power source V at a predetermined crank angle is effected as follows. In FIG. 6, an input signal pulse is produced as the detection signal for the crank angle when the crank angle is 0°. Subsequently, the time lag T for cutting off the power source V at the predetermined crank angle is determined. Although the time lag T is constituted by the time lag T1 of the monostable multi-vibrator circuit 100, operating time T2 of the relay Ry and ignition time for the triac 103, this may be represented by the equation T = T1 + T2 for actual use with the ignition time neglected.

Referring particularly to FIG. 6, the time lag or delay time T1 which occupies a large part of the time lag T is determined by the following formula on the basis of values of the fixed resistor R1 and variable resistor R2, and capacitor C1 connected between the collector of the transistor TR1 and the base of the transistor TR2 in the monostable multi-vibrator circuit 100.

$$T1 \approx 0.69\,(R1 + R2)\,C1$$

By setting the delay time T to such a degree that the crank angle falls between the range from 120° to 260°, the vibration of the motor compressor U at the time of shut-down is reduced to an extremely small level. Consequently, even when the spring constant for the spring members 19 (FIG. 1) for supporting the compressor components C is decreased during design to achieve sufficient vibration absorption during operation, it is not required to enlarge the sealed housing H more than necessary, with a consequent reduction of motor compressor size and highly improved sound insulation and vibration absorption.

It is to be noted here that the method for detecting the crank angle at the crank angle detection section D described in the foregoing embodiment as effected by the disk 15 (FIG. 1) having magnet members buried therein and the magnetic detection element 16 (FIG. 1) disposed adjacent to the disk 15. However, the detection of the crank angle may be modified in various ways, for example:

(1) A method for detecting pressure variations within the cylinder 4 by transducers, e.g. a conventional pressure gauge 15*b*, or the like through utilization of the characteristics that the pressure within the cylinder reaches a maximum value in the vicinity of 180° of the crank angle.

(2) A method for detecting variations of load for the driving means on the basis of the characteristics that the load variations for the driving motor are closely related to the crank angle.

(3) A method for detecting variations of the current waveforms of the driving motor M based on the characteristics that the electric current of the driving motor M reaches a maximum value in the vicinity of 180° of the crank angle, or (4) A method for detecting variations of vibrations by conventional vibration transducer elements, shown schematically at 15*c*, and the like by utilizing the characteristics that the state of variations for fundamental frequency of the motor compressor vibrations during continuous operation is closely related to positions of the crank angle.

It should also be noted that in the foregoing embodiment, although the present invention is mainly described with reference to the motor compressor employing the electric motor as the driving means, the concept of the present invention is not limited to such compressors driven by electric motors alone, but may readily be applicable to compressors driven by other driving means such as gasoline engines and the like through minor alterations in the arrangement, for example, by providing an arrangement to detect the angle of rotation of a crank shaft of such an engine.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A reciprocating compressor comprising:

a compression mechanism having compressor components including a cylinder member, a piston member reciprocable within said cylinder member, and crank mechanism means for driving said piston member such that said piston member reciprocates within said cylinder member between a top dead center position and a bottom dead center position;

motor means operatively coupled to said crank mechanism means and connectable to an electric power source for operating said crank mechanism means to thereby drive said piston member;

detection means for detecting when the relative position of said piston member within said cylinder member is within a predetermined range from said bottom dead center position, said predetermined range not including said top dead center position, and for generating an electric signal representative of such detection; and cut-off means operatively connected to said motor means for cutting off said motor means from said electric power source, said cut-off means being operatively connected to said detection means for receiving therefrom said electrical signal and for initiating said cutting off only upon receipt of said electrical signal.

2. A reciprocating compressor as claimed in claim 1, wherein said compressor components are integrally formed with said motor to form a single unit supported within a hermetically sealed housing by spring means.

3. A reciprocating compressor as claimed in claim 1, wherein said crank mechanism means comprises a crank shaft, and said detection means comprises means to detect the rotational angle of said shaft as a function of said relative position of said piston member.

4. A reciprocating compressor as claimed in claim 3, wherein said bottom dead center position of said piston member corresponds to a rotational angle position of said crank shaft of 180°, and said detection means detects when said rotational angle of said crank shaft is within a range of from 120° to 260°.

5. A reciprocating compressor as claimed in claim 3, wherein said detection means includes a magnet member provided on said crank shaft of said crank mechanism means and a magnetic detection element disposed adjacent to said crank shaft for detecting magnetism of said magnetic member.

6. A reciprocating compressor as claimed in claim 1, wherein said detection means comprises means to detect a pressure value within said compressor components as a function of said relative position of said piston member.

7. A reciprocating compressor as claimed in claim 6, wherein said detection means includes a transducer for detecting pressure within said cylinder member of the compressor components to generate an electrical signal which is supplied to said cut-off means.

8. A reciprocating compressor as claimed in claim 1, wherein said detection means comprises means to detect a vibration load for said compressor components and motor as a function of said relative position of said piston member.

9. A reciprocating compressor as claimed in claim 8, wherein said detection means includes a transducer for detecting vibration of said compression mechanism and motor to generate an electrical signal which is supplied to said cut-off means.

* * * * *